US009336668B2

(12) United States Patent
Luo

(10) Patent No.: US 9,336,668 B2
(45) Date of Patent: May 10, 2016

(54) ALARMING PINLESS SECURITY TAG

(71) Applicant: Tyco Fire & Security GmbH, Neuhausen Am Rheinfall (CH)

(72) Inventor: Danhui Luo, Lake Worth, FL (US)

(73) Assignee: Tyco Fire & Security GmbH, Rheinfall (CH)

( * ) Notice: Subject to any disclaimer, the term of this patent is extended or adjusted under 35 U.S.C. 154(b) by 142 days.

(21) Appl. No.: 14/453,803

(22) Filed: Aug. 7, 2014

(65) Prior Publication Data

US 2015/0048946 A1 Feb. 19, 2015

Related U.S. Application Data

(60) Provisional application No. 61/866,921, filed on Aug. 16, 2013.

(51) Int. Cl.
*G08B 13/14* (2006.01)
*G08B 13/24* (2006.01)
*E05B 73/00* (2006.01)

(52) U.S. Cl.
CPC ..... *G08B 13/2434* (2013.01); *E05B 73/0017* (2013.01)

(58) Field of Classification Search
CPC ..... G08B 13/2434; E05B 73/0017
USPC ..... 340/572.8, 10.1–10.6, 572.1–572.9
See application file for complete search history.

(56) References Cited

U.S. PATENT DOCUMENTS 5,068,641 A * 11/1991 Hogen Esch ..... G08B 13/14 340/551
5,687,459 A 11/1997 Vanmoor
8,917,180 B2 * 12/2014 Sayegh ..... E05B 73/0029 340/572.9
2012/0091741 A1 * 4/2012 Stewart ..... E05B 73/0017 292/307 A
2012/0267436 A1 * 10/2012 Yang ..... G08B 13/2434 235/492

* cited by examiner

*Primary Examiner* — Kerri McNally
(74) *Attorney, Agent, or Firm* — Fox Rothschild LLP; Robert J. Sacco; Carol E. Thorstad-Forsyth

(57) ABSTRACT

Systems (100) and methods (1200) for operating a security tag (132) of an Electronic Article Surveillance system. The methods involve: sliding a sidewall (202) of an article (102) into a clip structure (208) of the security tag; rotating at least one pawl (604) of the security tag so that the pawl is transitioned from a retracted position in which an engagement surface (606) of the pawl is disposed within a housing (302) of the security tag to an engaged position in which the engagement surface of the pawl extends out and away from the housing of the security tag; and applying a clamping force by the pawl to the article whereby the article is clamped between the engagement surface of the pawl and a vertical elongate member (406) of the clip structure.

20 Claims, 10 Drawing Sheets

ALARMING PINLESS SECURITY TAG

CROSS REFERENCE TO RELATED APPLICATIONS

This application claims the benefit of U.S. Provisional Patent Application No. 61/866,921 filed Aug. 16, 2013, the entirety of which is incorporated herein by reference.

FIELD OF THE INVENTION

This document relates generally to security tags attachable to objects. More particularly, this document relates to alarming pinless security tags.

BACKGROUND OF THE INVENTION

A typical Electronic Article Surveillance ("EAS") system in a retail setting may comprise a monitoring system and at least one security tag or marker attached to an article to be protected from unauthorized removal. The monitoring system establishes a surveillance zone (also referred to as an interrogation zone) in which the presence of security tags and/or markers can be detected. The surveillance zone is usually established at an access point for the controlled area (e.g., adjacent to a retail store entrance and/or exit). If an article enters the surveillance zone with an active security tag and/or marker, then an alarm may be triggered to indicate possible unauthorized removal thereof from the controlled area. In some scenarios, the security tag includes a processor and an alarm transducer disposed therein. This type of security tag is known as an alarming security tag. The alarm transducer can include, but is not limited to, a speaker, a Light Emitting Diode ("LED") and/or a vibration device. In contrast, if an article is authorized for removal from the controlled area, then the security tag and/or marker thereof can be deactivated and/or detached therefrom. Consequently, the article can be carried through the surveillance zone without being detected by the monitoring system and/or without triggering the alarm.

Radio Frequency Identification ("RFID") systems may also be used in a retail setting for inventory management and related security applications. In an RFID system, a reader transmits a Radio Frequency ("RF") carrier signal to an RFID device. The RFID device responds to the carrier signal with a data signal encoded with information stored by the RFID device. Increasingly, passive RFID labels are used in combination with EAS labels in retail applications.

As is known in the art, security tags for security and/or inventory systems can be constructed in any number of configurations. The desired configuration of the security tag is often dictated by the nature of the article to be protected. For example, pre-packaged goods which are subject to retail theft (e.g., Compact Discs and small electronic devices) may contain an EAS label disposed within the packaging thereof. In this case, the EAS label is located inside the packaging such that it is hidden form the consumer at least during the pre-purchase period.

EAS and/or RFID labels may be enclosed in a rigid tag housing, which can be secured to the monitored object (e.g., a piece of clothing in a retail store). The rigid housing typically includes a pin which is inserted through the fabric and secured in place on the opposite side. The housing cannot be removed from the clothing without destroying the housing except by using a dedicated removal device.

However, by inserting the pin through the fabric, the monitored object incurs some damage from the pin. High-end retailers and customers dislike having expensive merchandise (e.g., leather goods) damaged by retail theft deterrent devices. Shoes are especially difficult to protect using a device having a pin because the shoe material often suffers permanent damage from the pin.

Shoes present other difficulties for pinned security tags because shoe materials are often too rigid to insert the pin. Many retailers attempt to secure their merchandise using these hard tags in combination with pins, lanyards or both through a lace eyelet or in the tongue area. This practice is fine for a few shoe types, but the tag/pin/lanyard interferes with the fitting and lacing process of the merchandise. Thus, many shoes and boots cannot be tagged at all. In addition, for items such as boots, a pin may be too short to extend through the thickness of the boot material, thereby preventing the pin from being secured.

One solution is to use pinless security tags which "pinch" an article between a housing portion of the device and an arm portion of the device. Pinless security tags rely on the static force between the housing and the arm to maintain contact with the article being protected. Some pinless security tags are designed in such a way that the attachment mechanism requires using a great amount of compressive force, which can damage the shoes to which they are attached. It has been determined from pervious security tag products that customers do not purchase expensive shoes with a defect. For articles having smooth surfaces (such as articles made of leather) removal of the device can be accomplished by steadily working out the article from between the arm and the housing. When prior art pinless tags are attached to shoes, they may slide off if the proper application force has not been achieved. Even if the applied force is sufficient to prevent removal of the security tag from the shoe, the shoe can be permanently damaged by the impression left in the material by the security tag.

SUMMARY OF THE INVENTION

The present invention concerns implementing systems and methods for operating a security tag of an EAS system. The methods comprise: sliding a sidewall of an article into a clip structure of the security tag; rotating at least one pawl of the security tag so that the pawl is transitioned from a retracted position in which an engagement surface of the pawl is disposed within a housing of the security tag to an engaged position in which the engagement surface of the pawl extends out and away from the housing of the security tag; and applying a clamping force by the pawl to the article whereby the article is clamped between the engagement surface of the pawl and a vertical elongate member of the clip structure. Application of the clamping force can be removed using a magnetic field.

The clamping force is increased when an attempt is made to defeat the security tag. Also, an alarm is issued by the security tag when such an attempt is made to defeat the security tag. In this regard, it should be understood that in some scenarios the pawl is further rotated towards the article when an attempt is made to defeat the security tag such that two conductors come in contact with each other thereby closing an alarming circuit of the security tag.

The pawl may be caused to rotate using a spring loaded actuator. In this scenario, the method further comprises: moving the spring loaded actuator is a first direction so as to cause rotation of the pawl about a pivot in a first radial direction whereby the pawl is transitioned from the retracted position to the engaged position; and moving the spring loaded actuator in a second opposed direction so as to cause rotation of the pawl about the pivot in a second radial direction whereby the pawl is transitioned from the engaged position to the retracted position.

DESCRIPTION OF THE DRAWINGS

Embodiments will be described with reference to the following drawing figures, in which like numerals represent like items throughout the figures, and in which.

DETAILED DESCRIPTION OF THE INVENTION

Figure 1:
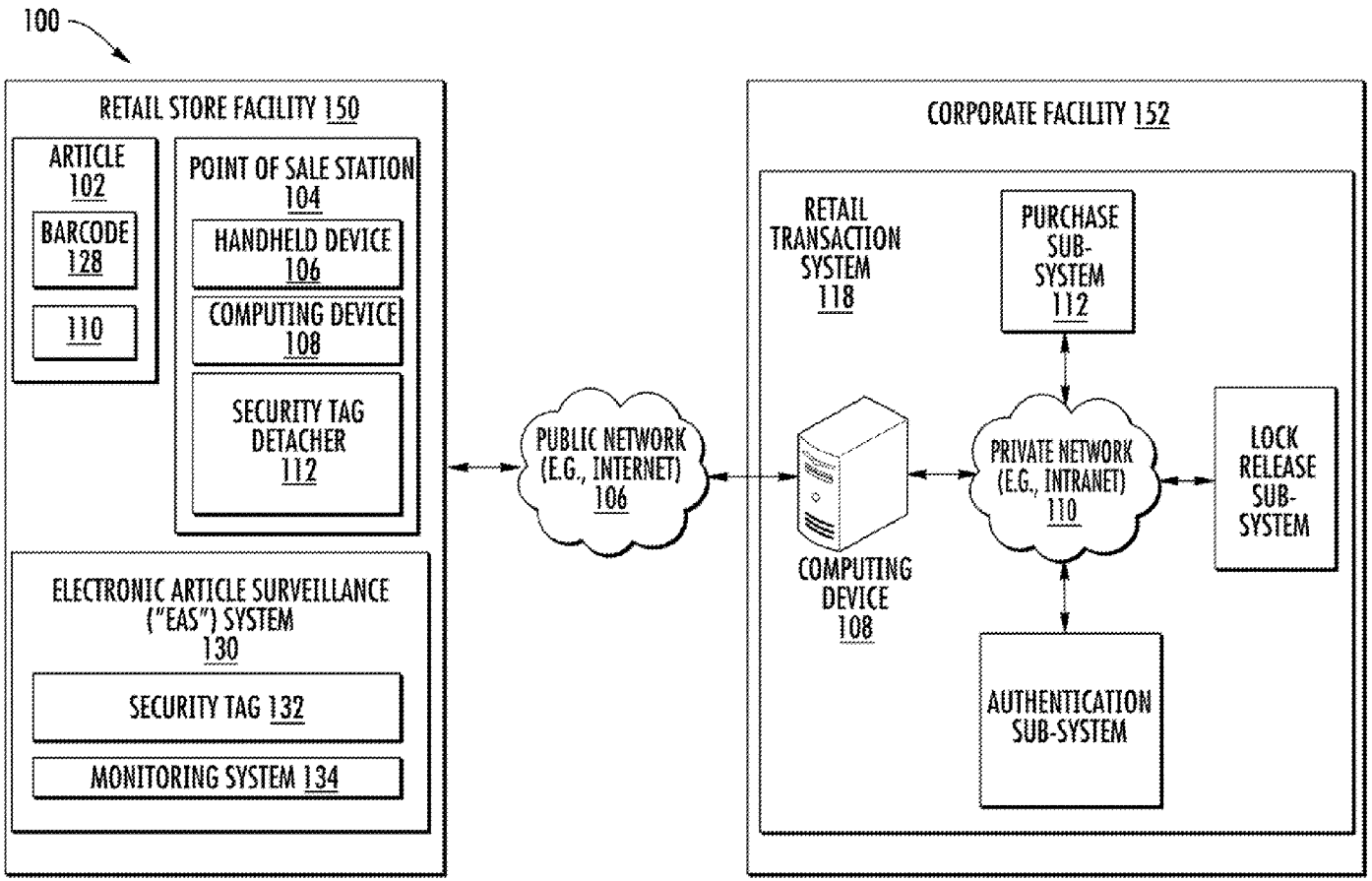
FIG. 1 is a schematic illustration of an exemplary system that is useful for understanding the present invention.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Embodiments of the present invention will now be described with respect to FIGS. 1-12. The present invention generally relates to novel systems and methods for providing an innovative security tag for articles (e.g., footwear) which can be used with an EAS system. In footwear scenarios, the security tag is configured to be attached to the side of a shoe, without exerting excessive compression force on the shoe (as is done by many conventional security tags such as those disclosed in the background section of this document). In this regard, the security tag comprises a clip and at least one rotatable pawl. The pawl is rotatable from a retracted position in which an engagement surface of the pawl is disposed within the housing of the security tag to an engaged position in which the engagement surface of the pawl extends out and away from the housing of the security tag. In the engaged position, the pawl applies a clamping force to a portion of an article disposed in the clip. Notably, the clamping force is automatically increased when an attempt is made to defeat the security tag. Also, an alarm is issued by the security tag when such an attempt is made to defeat the security tag.

Figure 2:
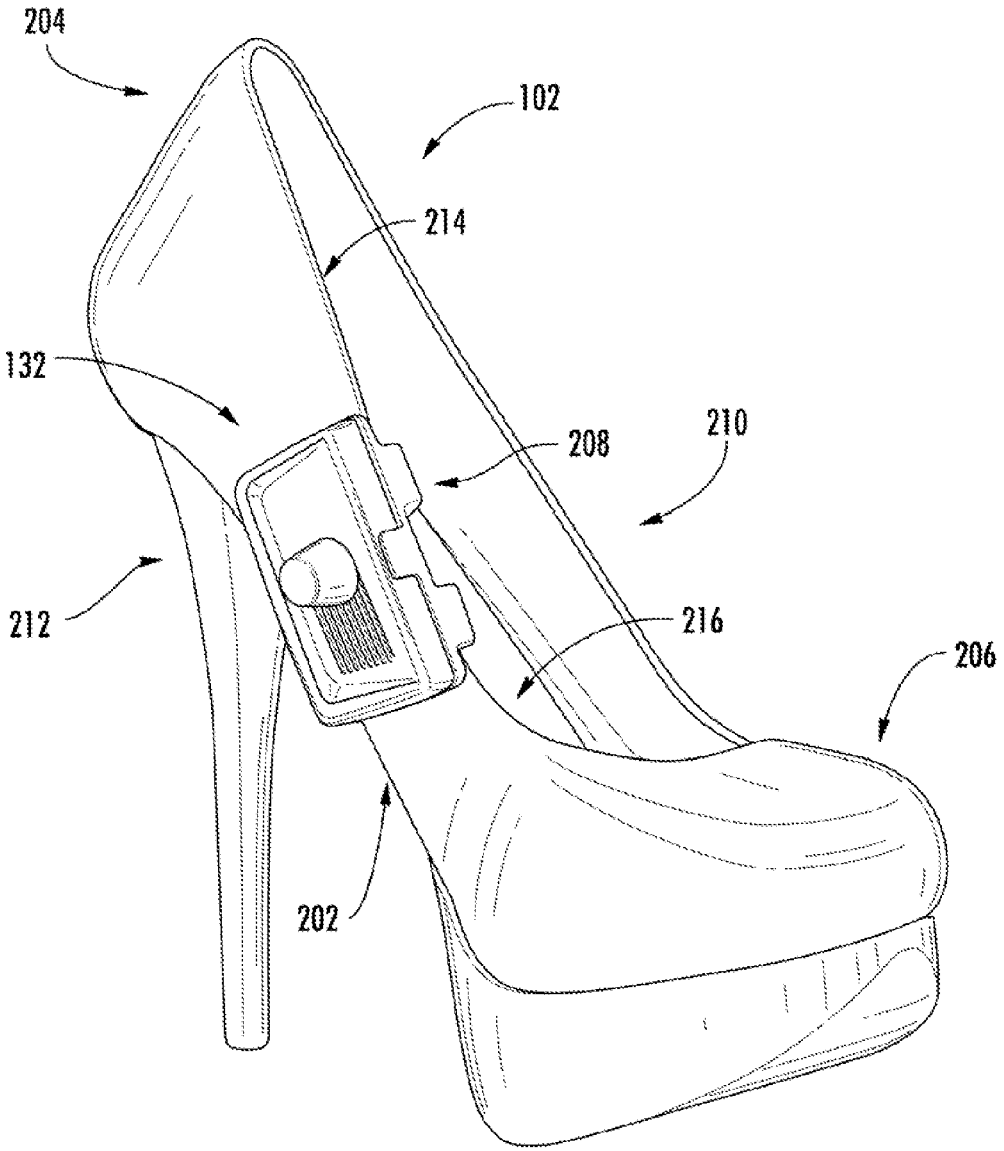
FIG. 2 is a perspective view of a shoe having a security tag coupled thereto that is useful for understanding the present invention.

Referring now to FIG. 1, there is provided schematic illustrations useful for understanding an exemplary system 100 in accordance with the present invention. System 100 comprises a retail store facility 150 including an EAS 130. The EAS 130 comprises a monitoring system 134 and at least one security tag 132. Although not shown in FIG. 1, the security tag 132 is attached to an article 102, thereby protecting the article 102 from an unauthorized removal from the retail store facility 150. A schematic illustration of the security tag 132 attached to an article 102 is provided in FIG. 2. As shown in FIG. 2, the article can include, but is not limited to, footwear. The monitoring system 134 establishes a surveillance zone (not shown) within which the presence of the security tag 132 can be detected. The surveillance zone is established at an access point (not shown) for the retail store facility 150. If the security tag 132 is carried into the surveillance zone, then an alarm is triggered to indicate a possible unauthorized removal of the article 102 from the retail store facility 150.

During store hours, a customer (not shown) may desire to purchase the article 102. The customer can purchase the article 102 using a Point Of Sale ("POS") station 104. The POS station 104 can include, but is not limited to, a traditional fixed POS station (e.g., a checkout counter) or a mobile POS station. In either scenario, a retail transaction application executing on a computing device 108 of the POS station 104 facilitates the exchange of data between the article 102, security tag 132, customer, store associate (not shown), and/or Retail Transaction System ("RTS") 118 of a corporate facility 152. For example, after the retail transaction application is launched, a store associate is prompted to start a retail transaction process for purchasing the article 102. The retail transaction process can be started simply by performing a user software interaction, such as depressing a key on a keypad of the computing device 108 or touching a button on a touch screen display of the computing device 108.

Subsequently, the store associate may manually input into the retail transaction application article information. Alternatively or additionally, the store associate may place a handheld device 106 of the POS station 104 in proximity of the article 102. As a result of this placement, the POS station 104 obtains article information from the article 102. The article information includes any information that is useful for purchasing the article 102, such as an article identifier and an article purchase price. In some scenarios, the article information may even include an identifier of the security tag 132 attached thereto. The article information can be communicated from the article 102 to the handheld device of the POS station 104 via a short range communication, such as a barcode communication or a Near Field Communication ("NFC").

In the barcode scenario, the article 102 has a barcode 128 attached to an exposed surface thereof. The term "barcode", as used herein, refers to a pattern or symbol that contains embedded data. Barcodes may include, for example, one-dimensional barcodes, two dimensional barcodes (such as matrix codes, Quick Response ("QR") codes, Aztec codes and the like), or three-dimensional bar codes. The embedded data can include, but is not limited to, a unique identifier of the article 102 and/or a purchase price of the article 102. The barcode 128 is read by a barcode scanner/reader (not shown in FIG. 1) of the POS station 104. Barcode scanners/readers are well known in the art. Any known or to be known barcode scanner/reader can be used herein without limitation.

In the NFC scenarios, article 102 may comprise an NFC enabled device 110. The NFC enabled device 110 can be separate from the security tag 132 or comprise the security tag 132. An NFC communication occurs between the NFC enabled device 110 and the handheld device 106 over a relatively small distance (e.g., N centimeters or N inches, where N is an integer such as twelve). The NFC communication may be established by touching components 102, 106 together or bringing them in close proximity such that an inductive coupling occurs between inductive circuits thereof. In some scenarios, the NFC operates at 13.56 MHz and at rates ranging from 106 kbit/s to 848 kbit/s. The NFC may be achieved using NFC transceivers configured to enable contactless communication at 13.56 MHz. NFC transceivers are well known in the art, and therefore will not be described in detail herein. Any known or to be known NFC transceivers can be used herein without limitation.

After the POS station 104 obtains the article information, payment information is input into the retail transaction application of POS station 104. The payment information can include, but is not limited to, a customer loyalty code, payment card information, and/or payment account information. The payment information can be input manually, via an electronic card reader (e.g., a magnetic strip card reader), or via a barcode reader. Electronic card readers and barcode readers are well known in the art, and therefore will not be described herein. Any known or to be known electronic card reader and/or barcode reader can be used herein without limitation. The payment information can alternatively or additionally be obtained from a remote data store based on a customer identifier or account identifier. In this case, the payment information can be retrieved from stored data associated with a previous sale of an article to the customer.

Upon obtaining the payment information, the POS station 104 automatically performs operations for establishing a retail transaction session with the RTS 118. The retail transaction session can involve: communicating the article information and payment information from the POS station 104 to the RTS 118 via a public network 106 (e.g., the Internet); completing a purchase transaction by the RTS 118; and communicating a response message from the RTS 118 to the POS station 104 indicating that the article 102 has been successfully or unsuccessfully purchased. The purchase transaction can involve using an authorized payment system, such as a bank Automatic Clearing House ("ACH") payment system, a credit/debit card authorization system, or a third party system (e.g., PayPal®, SolidTrust Pay® or Google Wallet®).

The purchase transaction can be completed by the RTS 118 using the article information and payment information. In this regard, such information may be received by a computing device 108 of the RTS 118 and forwarded thereby to a subsystem of a private network 110 (e.g., an Intranet). For example, the article information and purchase information can also be forwarded to and processed by a purchase subsystem 112 to complete a purchase transaction. When the purchase transaction is completed, a message is generated and sent to the POS station 104 indicating whether the article 102 has been successfully or unsuccessfully purchased.

If the article 102 has been successfully purchased, then a security tag detaching process can be started. During the security tag detaching process, a security tag detacher 112 of the POS station 104 is used to cause actuation of a detaching mechanism of the security tag 132. Once the security tag 132 has been detached from article 102, the customer can carry the article 102 through the surveillance zone without setting off the alarm.

Referring now to FIG. 2, there is provided a schematic illustration of the security tag 132 attached to the article 102. As noted above, the article 102 can include, but is not limited to, a heeled shoe. As such, the security tag 132 will be described here in relation to a heeled shoe. However, the present invention is not limited in this regard. The security tag can be used with other types of articles, which have a sidewall on which a clip can be attached.

As shown in FIG. 2, the security tag 132 is generally designed to be removably coupled a quarter 202 of the shoe (i.e., the horizontal portion of the shoe connecting the counter 204 and toe box 206 thereof), without exerting excessive pressure or compression force on the shoe. In this regard, the security tag 132 comprises at least one engagement member 208 (e.g., a clip) designed to slidingly receive the quarter 202 of the shoe so as to couple the security tag 132 thereto. The engagement member 208 will be described in more detail below. Still, it should be understood that engagement member 208 is configured to have a portion shaped to mate or match the exterior profile of the quarter 202, so as to (a) minimize or eliminate any potential damage to the shoe by the security tag 132, (b) ensure that the alignment between the security tag 132 and the quarter 202 is maintained, and/or (c) allow one to comfortably try on the shoe without distraction or annoyance from the security tag 132.

In some scenarios, the security tag 132 is designed to expel ink when a sensor (not shown) thereof detects an attempt to break the engagement member 208 and/or detects that the engagement member 208 has been broken. Various audio (e.g., an alarm), visual (e.g., light), and/or tactile (e.g., vibration) indicators can also be output from the security tag 132 when an unauthorized attempt is made to remove the security tag from the article, or from a particular geographic location. Also, a disposable cloth or sleeve can be provided for removable disposition on the engagement member 208 so as to increase the cleanliness of the security tag when used to protect articles by the general public.

As evident from FIG. 2, the engagement member 208 is not overly visible from a side 210 of the shoe that is opposed from the side 212 of the shoe on which the security tag is disposed. In this regard, it should be understood that the engagement member 208 do not obstruct the side 210 view of the shoe by a wearer. Also, the engagement member 208 can be at least partially formed from a transparent material (e.g., a clear plastic) so as to further minimize obstruction of the shoe's appearance by the security tag. Embodiments of the present invention are not limited in this regard. The engagement member 208 can alternatively be formed of an opaque material, such as an opaque plastic.

Figure 3:
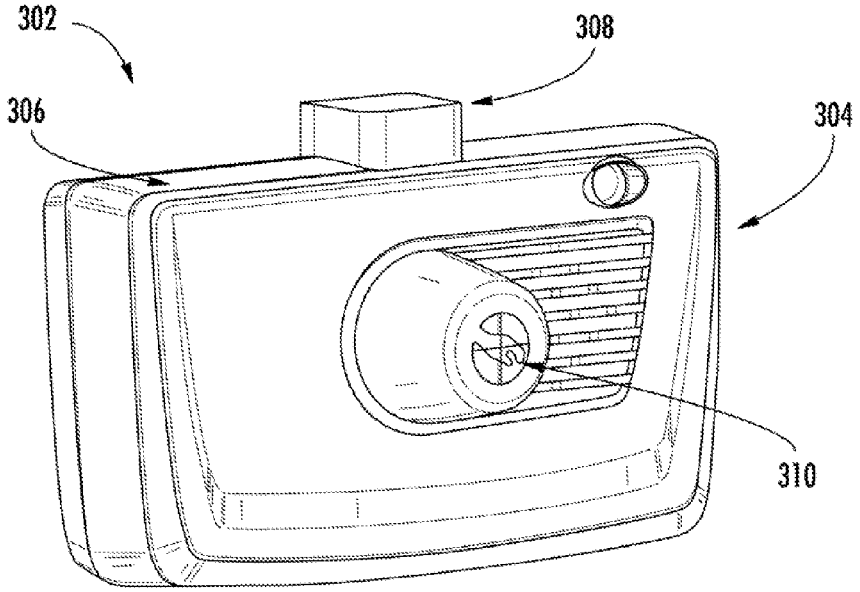
FIG. 3 is a front perspective view the security tag shown in FIG. 2.
Figure 4:
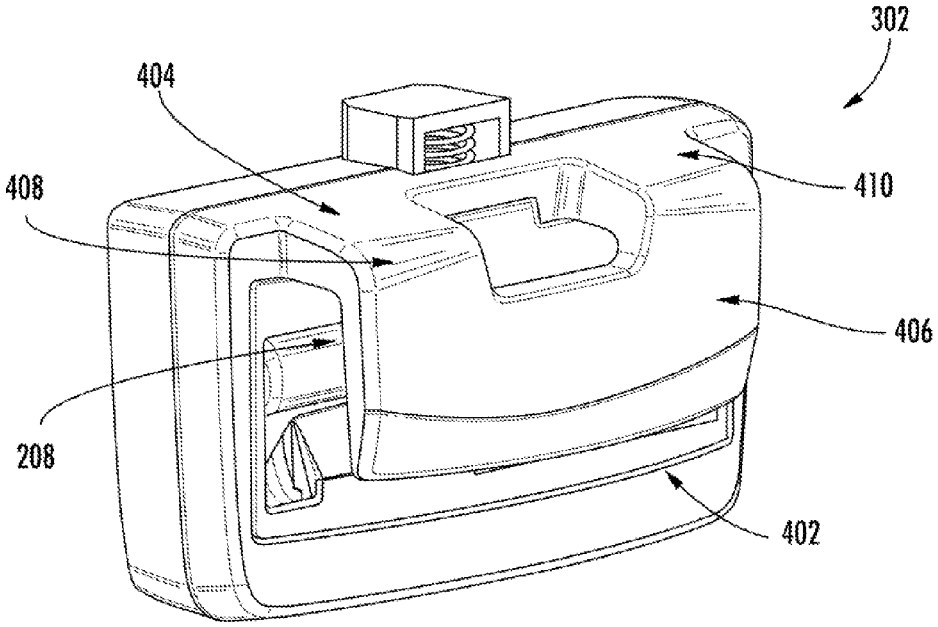
FIG. 4 is a back perspective view the security tag shown in FIG. 2.
Figure 5:
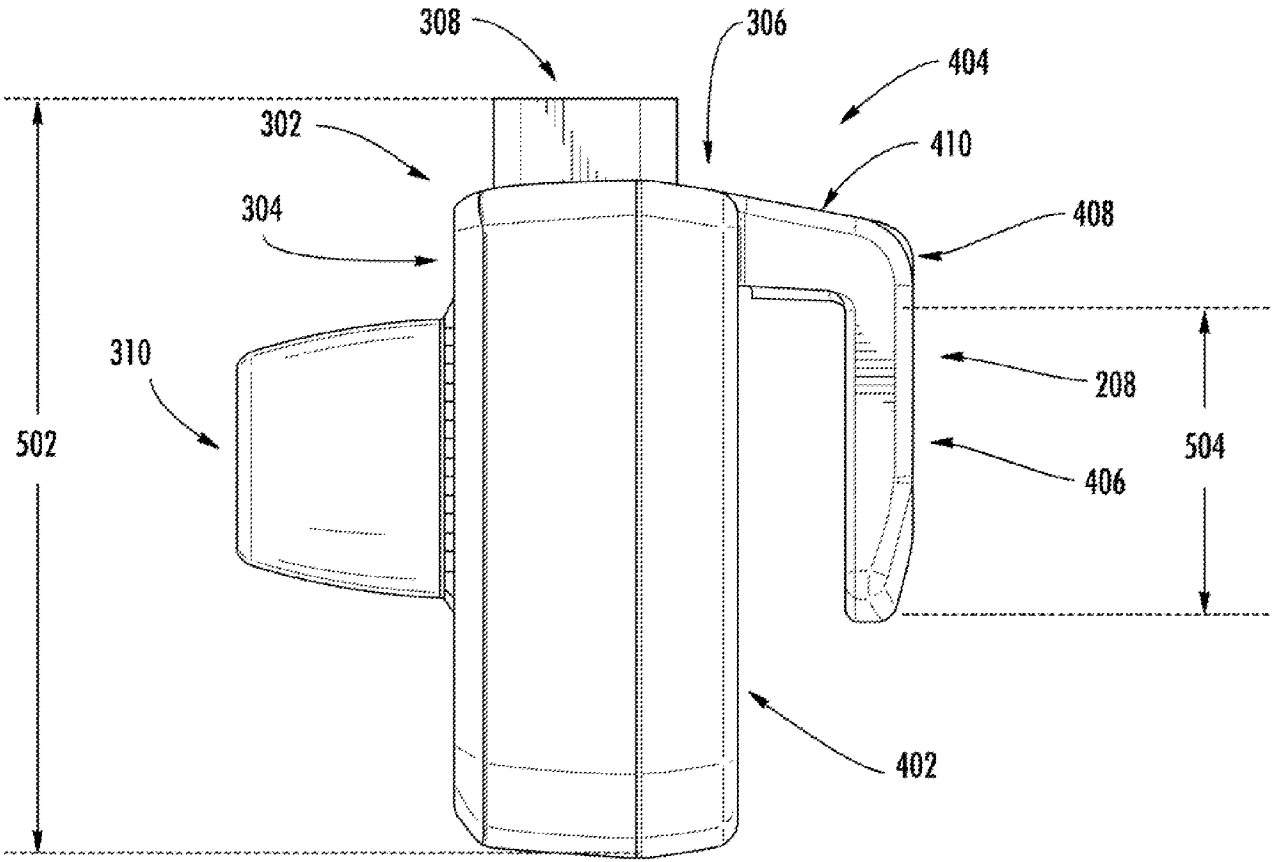
FIG. 5 is a side view of the security tag shown in FIG. 2.
Figure 6:
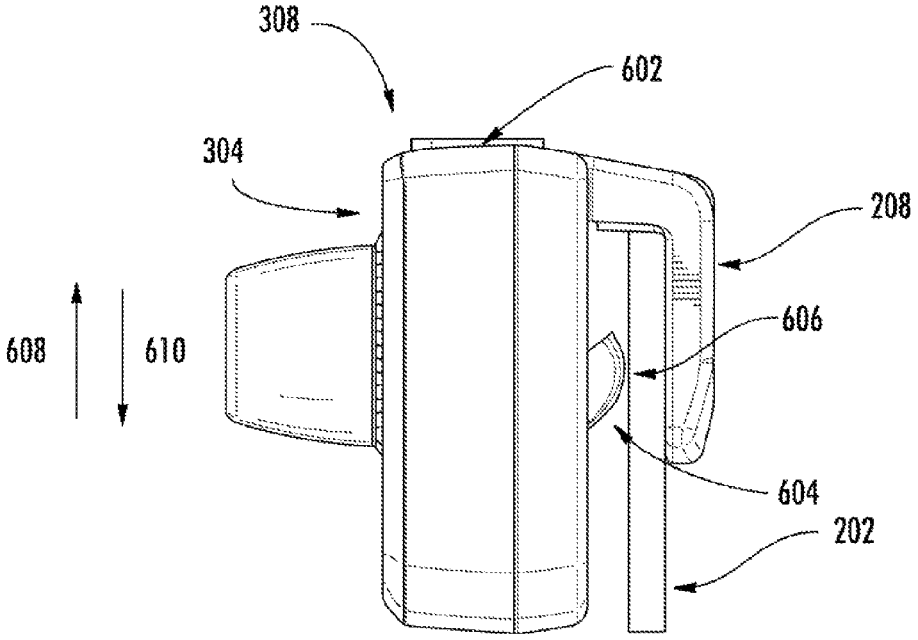
FIGS. 6-7 collectively provide schematic illustrations that are useful for understanding operations of the security tag shown in FIG. 2.
Figure 7:
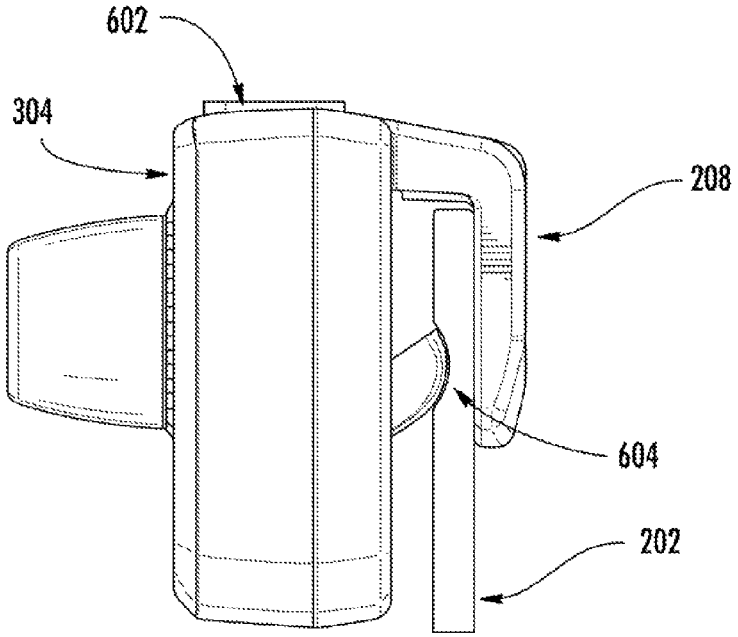
Figure 8:
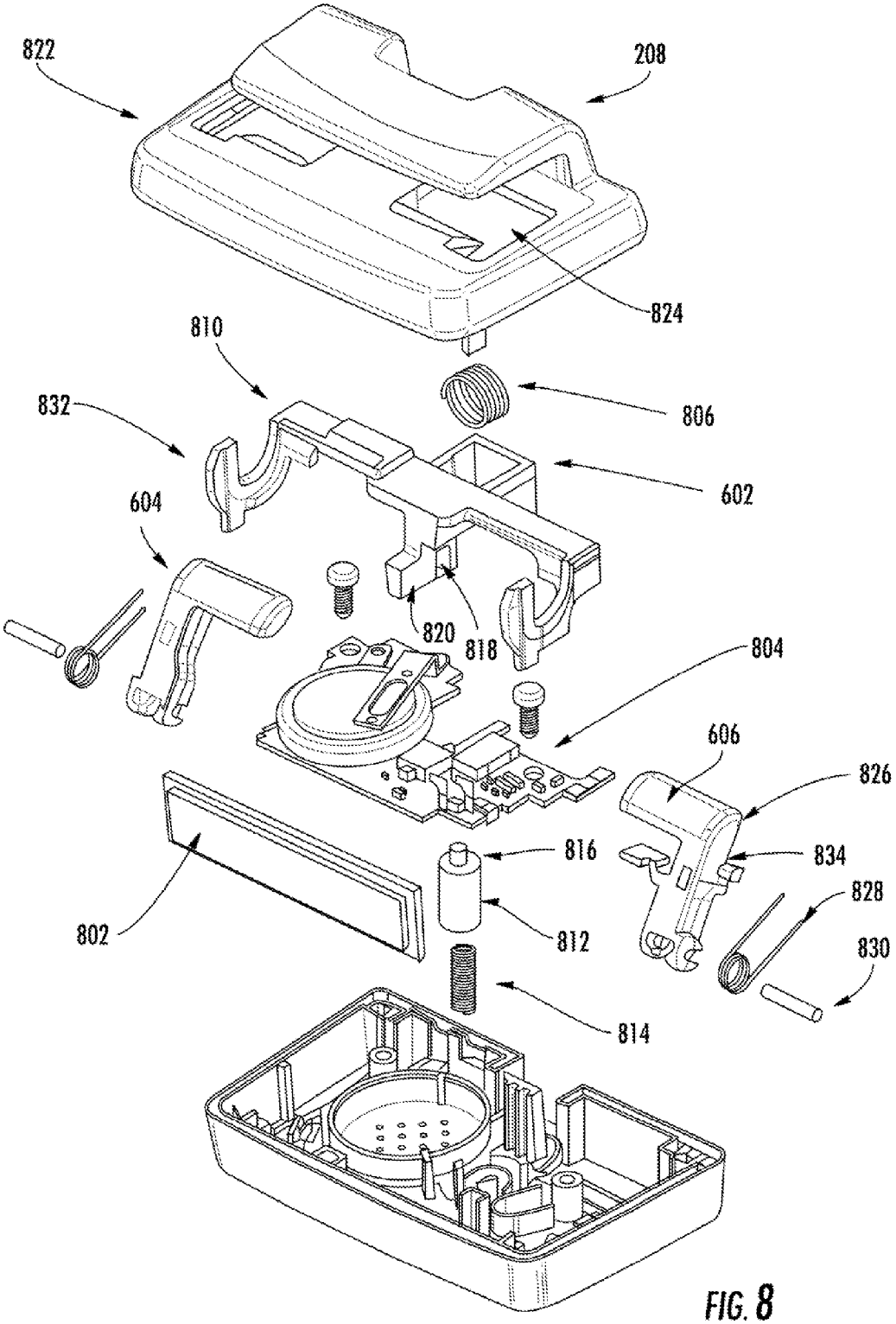
FIG. 8 is an exploded view of the security tag shown in FIG. 2.

The security tag 132 will now be described in more detail in relation to FIGS. 3-8. FIG. 3 is a front perspective view the security tag shown in FIG. 2. FIG. 4 is a back perspective view the security tag shown in FIG. 2. FIG. 5 is a side view of the security tag shown in FIG. 2. FIGS. 6-7 collectively provide schematic illustrations that are useful for understanding operations of the security tag shown in FIG. 2. FIG. 8 is an assembly view of the security tag 132.

As shown in FIGS. 3-8, the security tag 132 comprises a housing 302. The housing 302 can be formed from any suitable material, such as plastic. The material from which the housing 302 is formed may be transparent or opaque. However, there are many advantages to using transparent materials for the housing 302. For example, transparent materials facilitate the minimization of any obstruction of the article's appearance by the security tag 132.

Housing 302 is generally configured to align with the contours of the shoe surface to which it is to be coupled (e.g., the quarter 202). In this regard, the housing 302 comprises a main body 304 formed of a rigid or semi-rigid material. The main body 304 is sized and shaped to have a total height 502 less than or approximately equal to the total height of the shoe surface to which it is to be coupled (e.g., the quarter 202). In some scenarios, at least a back surface 402 of the main body 304 is relatively smooth and flat. In other scenarios, at least a back surface 402 of the main body 304 is relatively smooth and contoured to follow any curvature of the shoe surface to which it is to be coupled (e.g., the quarter 202). For example, the back surface 402 can have a generally smooth, slightly concave contour. As such, damage is not caused to the shoe if and when the back surface 402 contacts the shoe surface during use of the security tag 132. At least one member (e.g., a rubber member) may also be provided on the back surface 402 to help prevent the rotation and/or linear movement of the housing 302 relative to the shoe.

Various electronic components 804 are disposed within the main body 304 of the housing 302 which render the security tag 132 operative for securing an article. These components can include, but are not limited to, an antenna, a microprocessor, an RFID logic block, an alarming tag processor, an alarm transducer, an EAS sensor, a tampering sensor, an ink ejector and/or a replaceable/rechargeable power supply (e.g., a battery). Each of these listed components are well known in the art, and therefore will not be described in detail herein. Still, it should be understood that the RFID logic block may implement the behavior of a standard RFID tag, including the standard functionality currently found in passive RFID tags and/or active alarming tags (e.g., identifier numbering, data areas, encoding according to industry or customer standards, RFID tracking operations, and inventory operations). The alarm transducer emits sound, light and/or a tactile indicator when an alarm is triggered. In this regard, the alarm transducer may include, but is not limited to, a speaker, an LED and/or a vibration device.

In some scenarios, a security label 802 is also disposed within the main body 304 of the housing 302 or affixed to an exposed surface of the main body 304. Security labels are well known in the art, and therefore will not be described herein. Any known or to be known security label can be used herein without limitation. Still, it should be understood that the security label provides a way to detect when an article is being removed from a particular area by an unauthorized person(s) or in an unauthorized manner (e.g., without being purchased). As such, the security label includes a sensor operable with EAS technology. Such sensors can include, but are not limited to, an NFC sensor and/or an RFID sensor. In some scenarios, the security label is configured to provide an audible, visual and/or tactile alarm when it passes into the surveillance zone of an EAS system. An exemplary security label which can be used herein is the EAS Ultra•Max® narrow label sensor made by Sensormatic® Electronics Corporation.

The engagement member 208 is attached or coupled to the housing 302 at or near a top portion 306 of the housing's main body 304. In this regard, the engagement member 208 comprises a coupling section 404 configured to couple a vertical elongate member 406 to the housing 302. In some scenarios, the coupling section 404 has a curved portion 408 configured to couple the vertical elongate member 406 to a horizontal elongate portion 410 thereof. The vertical elongate member 406 is affixed to or is integrally formed with the coupling section 404 of the engagement member 208. The vertical elongate member 406 extends along and is aligned with at least a portion of the back surface 402 of the housing's main body 304. As such, the vertical elongate member 406 is in a mutually tensioned arrangement with the back surface 402 such that at least a portion of an article can be held or gripped therebetween (e.g., as shown in FIG. 2). In some scenarios, the vertical elongate member 406 has (a) a length 504 which is less than the distance between the top surface 214 of the quarter 202 and the shoe's insole 216 and/or (b) is contoured to follow a curve of the interior surface of a shoe's quarter 202. Accordingly, the interior of the shoe is not damaged by the vertical elongate member 406 when the security tag is in use.

The present invention is not limited to the exemplary architecture of the coupling section 404 shown in FIGS. 3-7. For example, the coupling section 404 can alternatively have a generally U-shape or C-shape which is configured to allow a security tag to hang on an edge of an article (e.g., a shoe as shown in FIG. 2). Also, a soft material can be disposed on the vertical elongate member 406 of the engagement member 208 for improving the comfort level of a person trying on the shoe. Alternatively or additionally, a disposable cloth sleeve can be provided for removable disposition on the engagement member 208 so as to improve the comfort level of a person trying on the shoe, as well as increase the cleanliness of the security tag when used to protect articles accessible by the general public.

Once the security tag 132 is placed in position on the article, it can be locked in position by a locking mechanism 308 (e.g., a button). In the locked position, the security tag 132 cannot be removed from the article (e.g., a show as shown in FIG. 2). The lock can be subsequently released using an unlocking mechanism 310. In some scenarios, the unlocking mechanism 310 comprises a magnetic unlocking mechanism which is unlocked via application of a magnetic field thereto. The magnetic field can be applied by a detacher of an EAS system (e.g., detacher 112 of FIG. 1). Detachers are well known in the art, and therefore will not be described herein.

An exemplary architecture for the locking mechanism 308 will be described below in relation to FIGS. 6-8. The locking mechanism 308 includes an actuator 602. The actuator 602 includes a spring loaded button. As such, the actuator 602 is transitionable from a rest position shown in FIG. 5 to a depressed position shown in FIGS. 6-7. The actuator 602 is normally biased to its rest position by a spring 806. In this regard, the spring 806 is normally in an uncompressed state. When the actuator 602 is depressed, the spring 806 transitions from its uncompressed state to a compressed state. The actuator 602 is maintained in its depressed position by a plunger assembly.

The plunger assembly comprises a plunger 812 and a spring 814. The plunger 812 has a post 816 disposed at a top end thereof. The post 816 is sized and shaped to fit within an insert space 818 formed in the actuator body 810. Notably, the actuator 602 is integrally formed with or coupled to a generally C-shaped actuator body 810. Thus, when the post 816 resides in the insert space 818 of the actuator body 810, the actuator 602 is retained in its depressed position.

Notably, the post 816 resides adjacent surface 820 when the actuator 602 is in its rest position shown in FIG. 5. The plunger 812 is transitioned from its retaining position (i.e., the position when the post 816 resides in the insert space 818) to its rest position (i.e., when the post 816 resides adjacent surface 820) via application of a magnetic field thereto. The magnetic field needs to be strong enough to overcome at least the spring force applied by spring 814 to plunger 812, but not necessarily a frictional force between exposed surfaces of post 816 and a concave aperture defining insert space 818. Thus, application of the magnetic field at least causes the spring 814 to transition from its uncompressed state to its compressed state. If the plunger 812 is not caused to move away from the actuator body 810 in response to the application of the magnetic field thereto, then a user can depress the actuator 602 so as to manually cause the plunger 812 to move accordingly.

When the spring 814 is in its compressed state and the post 816 no longer resides in insert space 818, the actuator 602 is caused to transition to its rest position by spring 806. As noted above, the actuator 602 is integrally formed with or coupled to the actuator body 810. Thus, when the actuator 602 transitions to its rest position, the actuator body 810 is caused to move in the same direction 610 as the actuator 602 such that the surface 820 is placed on top of the post 816. Upon a termination of the application of the magnetic field, the spring 814 transitions back to its uncompressed state so as to apply a pushing force on the plunger 812, whereby the post 816 is caused to come in contact with surface 820 of the actuator body 810.

Depression of the actuator 602 causes the actuator body 810 to move in a direction shown by arrow 608 in FIG. 6. In effect, the pawls 604, 826 are caused to rotate out and away from the security tag housing 302, whereby an article is engaged by the pawls 604, 826. Notably, when the security tag is in use, linear pulling of the security tag away from the article causes the pawls 604, 826 to increase the clamping force applied thereby to the article. Movement of the actuator 602 to its rest position causes the actuator body 810 to move in a direction shown by arrow 610 in FIG. 6. In turn, the pawls 604, 826 are caused to rotate towards and into the security tag housing 302. The manner in which rotation of the pawls 604, 826 is achieved will become more evident as the discussion progresses.

Two pawls 604, 826 are shown in the figures. However, the present invention is not limited in this regard. For example, any number of pawls can be employed by the present invention (e.g., N pawls are employed, where N is an integer greater than or equal to one). Although one pawl will work to secure the security tag to an article, the inclusion of additional pawls improves resistance for rotating the security tag and/or moving the security tag in a linear direction so as to attempt a defeat of the security tag. Notably, a housing segment 822 has N apertures 824 formed therethrough for allowing the pawl(s) 604, 826 to pass through the housing 302 and make contact with an article.

Each pawl 604, 826 has an engagement surface 606 which engages an article when the security tag is in use. The engagement surface 606 is designed to apply a compression force to the side of the article such that the article is clamped between itself and the vertical elongate member 406 of the engagement member 208. The compression force is of an amount which will not cause damage to the article when the security tag is at least in a normal use state. Also, the engagement surface 606 has a smooth, contoured shape which will not cause damage to the article. Additionally or alternatively, at least one member may also be provided on the engagement surface 606 to help prevent the rotation and/or linear movement of the security tag relative to the shoe. The member may include rubber or any other material which will provide friction between the pawl 604 and the article. This member can have any shape or design. For example, the member includes one elongate rubber piece, N parallel elongate rubber pieces which are spaced apart from each other, and/or a plurality of circular, square or rectangular rubber pieces arranged in a particular geometric pattern.

Each pawl 604, 826 is coupled to a torsion spring 828 via a post 830. Torsion springs are well known in the art, and therefore will not be described in detail herein. Still, it should be understood that that torsion spring 828 is arranged to apply a pushing force to the pawl 604, 826 in a direction out and away from the security tag housing 302 when the actuator 602 is in its rest position and/or various other intermediary depressed positions. In order to control the position of the pawl 604, 826 relative to the security tag housing 302, each pawl 604, 826 is provided with a protrusion 834 for engagement with a respective Position Control Structure ("PCS") 832 of the actuator body 810. The operational relationship between these components 832, 834 will now be discussed in detail in relation to FIGS. 9-10. Notably, torsion spring 828 and some other components are not shown in FIGS. 9-10 simply for ease of discussion.

Figure 9:
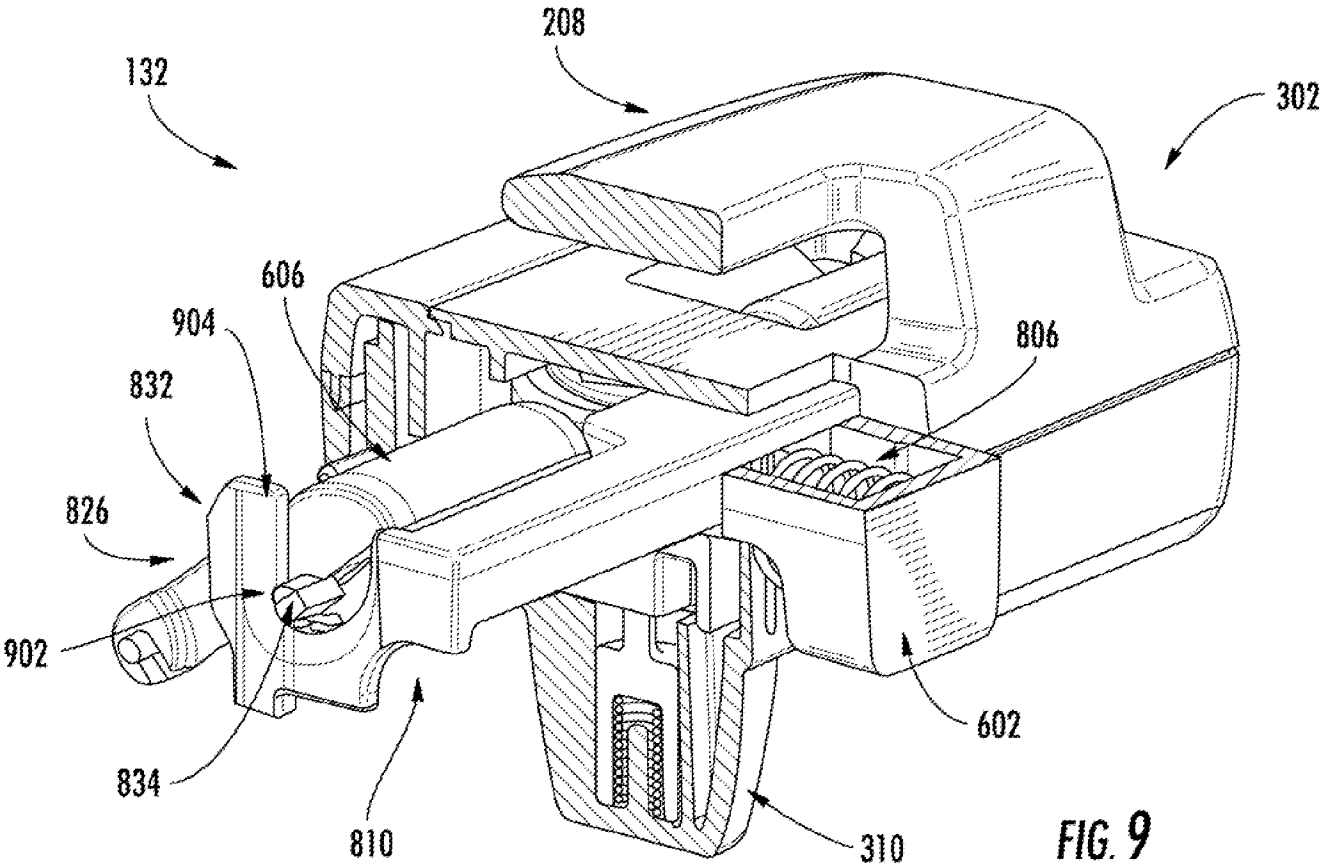
FIGS. 9-10 provide schematic illustrations that are collectively useful for understanding the operational relationship between various components of the security tag shown in FIG. 2.

As shown in FIG. 9, the actuator 602 is in its rest position. In this case, the pawl 826 resides entirely within the security tag housing 302 such that a compression force is not applied thereby to an article. The pawl 826 is at least partially retained in this retracted position by its protrusion 834. Protrusion 834 has a stopper 902 integrally formed therewith or attached thereto. The stopper 902 is arranged to contact a stop surface 904 of the PCS 832 when the actuator 602 is in its rest position, thereby retaining the pawl 826 in its retracted position. Notably, in this scenario, the pushing force applied by the twisted torsion spring 828 to PCS 832 via pawl 826 is not sufficient to overcome the pushing force applied by uncompressed spring 806 to the actuator 602.

Figure 10:
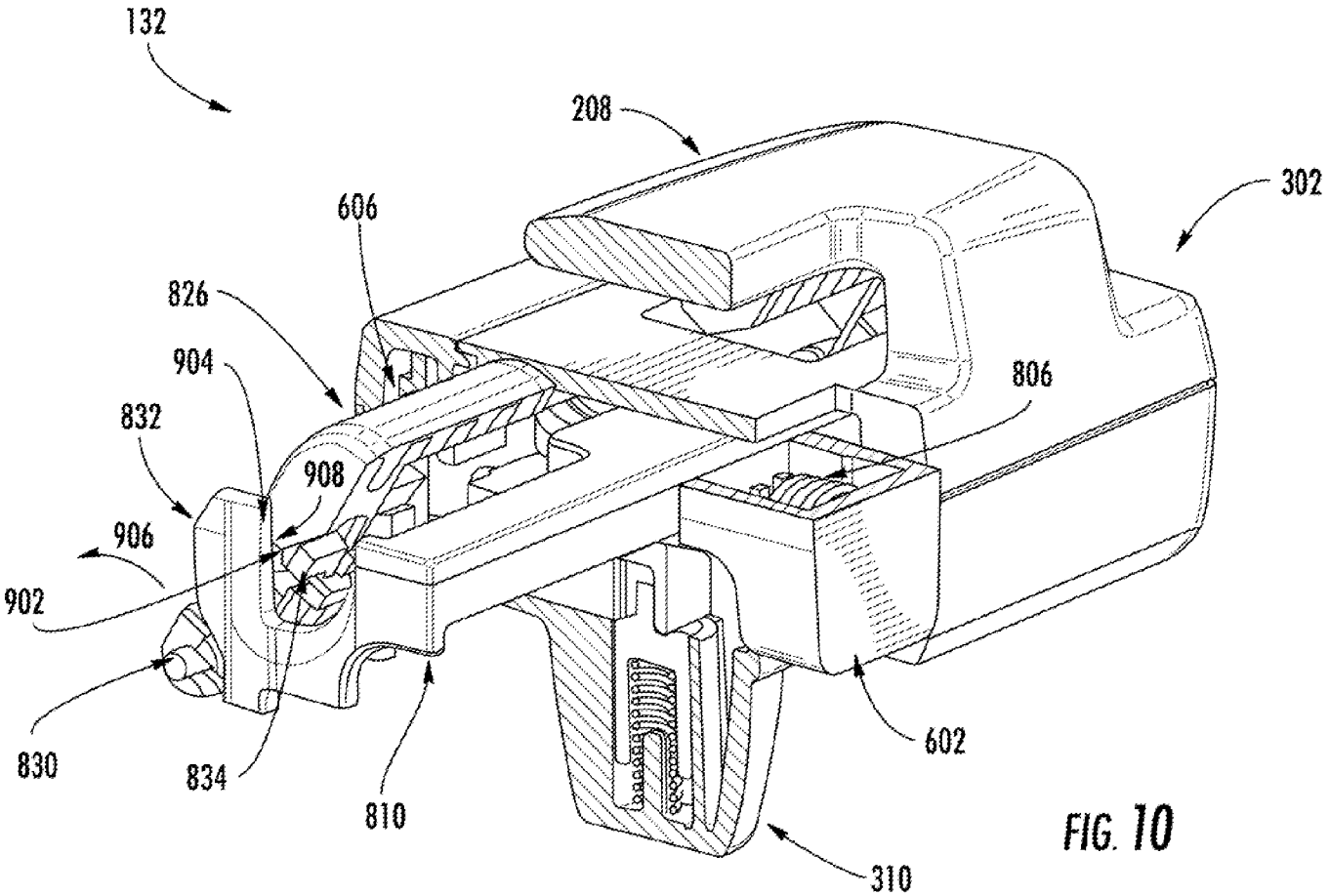

As shown in FIG. 10, the actuator 602 is in its depressed position. Consequently, the actuator body 810 has been moved in a direction shown by arrow 608 of FIG. 6. In effect, the PCS 832 has been moved away from protrusion 834 of the pawl 826, whereby a gap 908 is formed between the stopper 902 and the stop surface 904. In turn, the torsion spring 828 transitions from its twisted position to an untwisted position, whereby a pushing force is applied to the pawl 826 in a direction shown by arrow 906 such that the pawl 826 rotates about post 830. When the torsion spring 828 resides in its fully untwisted position or an intermediary less twisted position, the engagement surface 606 of the pawl 826 extends out of the housing 302 such that a compression force may be applied by the pawl 826 to an article.

Figure 11:
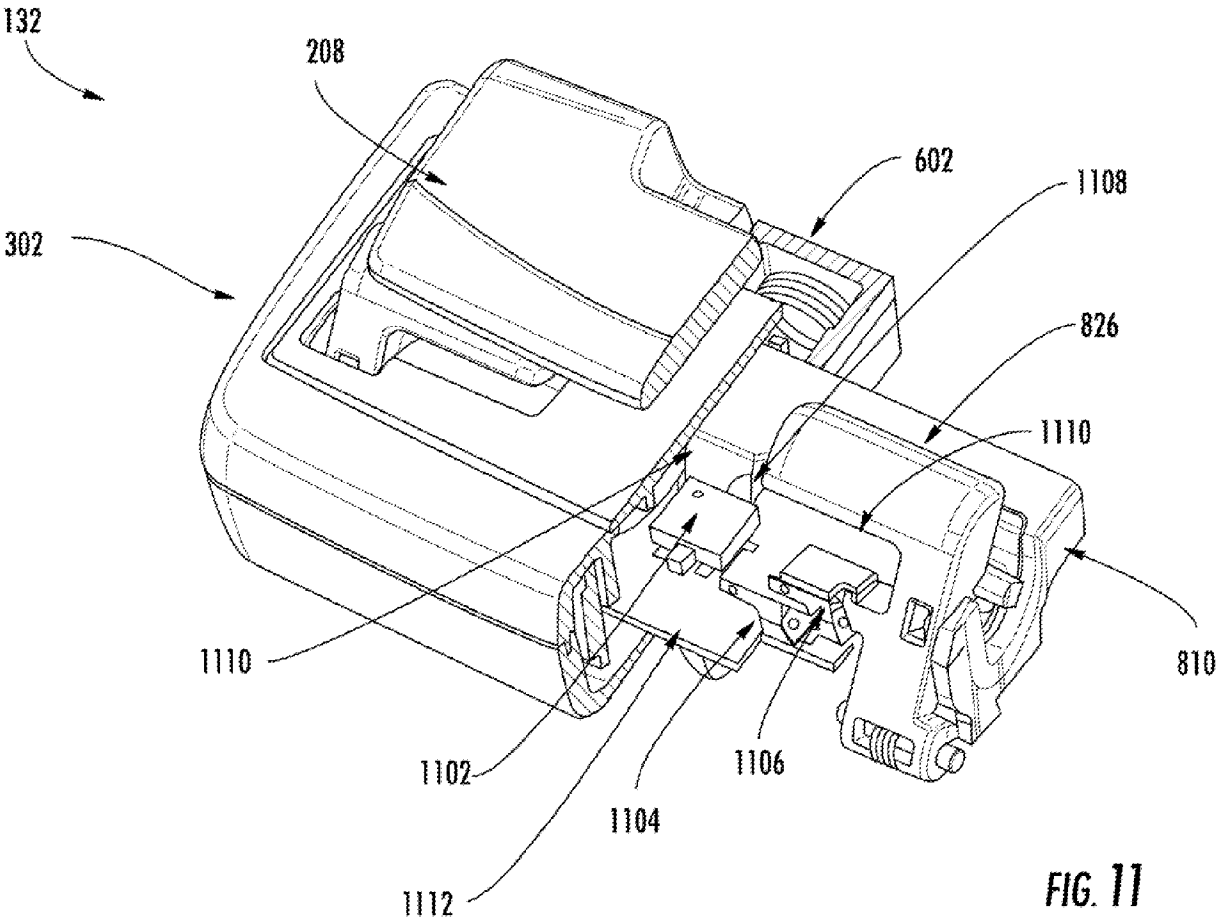
FIG. 11 is a schematic illustration of an exemplary alarming architecture implemented by a security tag.

Referring now to FIG. 11, there is provided a schematic illustration that is useful for understanding an exemplary alarming architecture implemented by the security tag 132. The alarming architecture comprises a switch 1102 and conductors 1104, 1106. The switch 1102 is actuated when a protrusion 1108 is depressed by the actuator body 810. In this regard, the actuator body 810 is provided with a surface 1110 for applying a pushing force on the protrusion 1108 when the actuator 602 is depressed. When the switch is actuated, alarming circuitry 804 of the security tag 132 is placed in its armed state. In the armed state, an alarm can be triggered when an unauthorized attempt is made to remove the security tag 132 from an article. The alarming circuitry 804 is transitioned from its armed state to its unarmed state when the actuator 602 is released (i.e., moved from its depressed position shown in FIG. 11 to its rest position shown in FIG. 5). In the unarmed state, the alarm cannot be triggered.

The alarm is triggered when the pawl 826 is moved a certain distance in a direction shown by arrow 1110 to deflect conductor 1106 in contact with conductor 1104. Conductor 1106 and conductor 1104 are both disposed on the stationary circuit board 1112. When conductors 1104 and 1106 contact each other, an alarm circuit is closed whereby an alarm is issued. The alarm can include, but is not limited to, an auditory alarm (e.g., a sound output from a speaker), a visual alarm (e.g., light emitted from an LED), or a tactile alarm (e.g., vibration generated by a vibration device). Additionally or alternatively, alarm information can be transmitted from the security tag 132 to an EAS system or other remote computing device, when an alarm is issued. Notably, the conductors 1104 and 1106 do not contact each other during normal use of the security tag. Instead, the conductors 1104 and 1106 come in contact with each other when an attempt is made to defeat the security tag by pulling the security tag away from an article to which it is attached.

The present invention is not limited to the alarming architecture shown in FIG. 11. For example, the conductors 1104 and 1106 can be replaced with or used in conjunction with sensors operative to detect an angle of rotation of the pawl 826 relative to a reference point.

Figure 12:
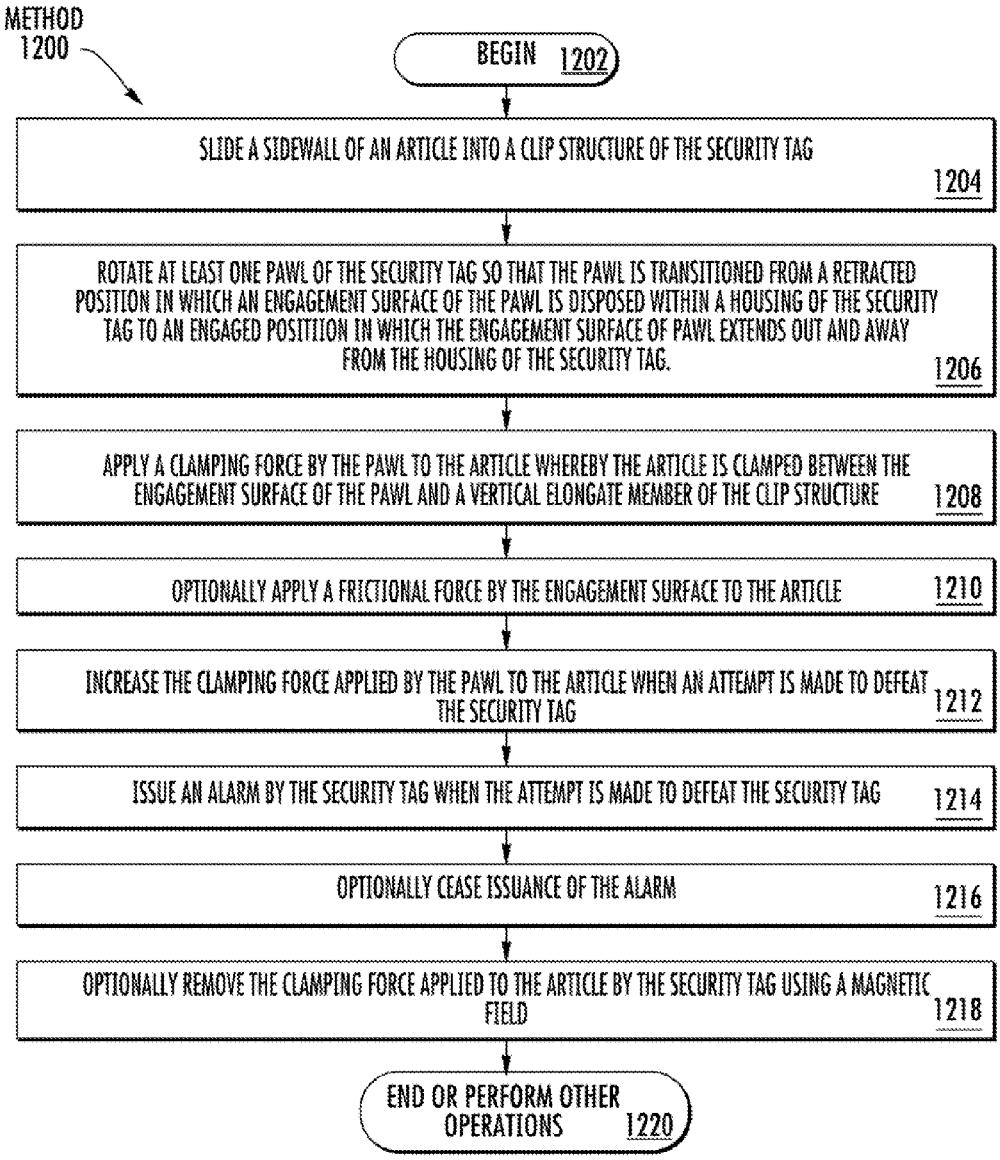
FIG. 12 is a flow diagram of an exemplary method for operating a security tag of an EAS system.

Referring now to FIG. 12, there is provided a flow diagram of an exemplary method 1200 for operating a security tag (e.g., security tag 132 of FIGS. 1-11) of an EAS system (e.g., EAS system 100 of FIG. 1). Method 1200 begins with step 1202 and continues with step 1204. Step 1204 involves sliding a sidewall of an article (e.g., shoe 102 of FIG. 2) into a clip structure (e.g., clip 208 of FIG. 2) of the security tag. Next in step 1206, at least one pawl (e.g., pawl 604 of FIG. 6) of the security tag is rotated so that the pawl is transitioned from a retracted position in which an engagement surface (e.g., engagement surface 606 of FIG. 6) of the pawl is disposed within a housing (e.g., housing 302 of FIG. 3) of the security tag (e.g., as shown in FIG. 5) to an engaged position in which the engagement surface of the pawl extends out and away from the housing of the security tag (e.g., as shown in FIGS. 6-7). A clamping force is applied by the pawl to the article whereby the article is clamped between the engagement surface of the pawl and a vertical elongate member (e.g., vertical elongate member 406 of FIG. 4) of the clip structure, as shown by step 1208. In optional step 1210, a frictional force is also applied by the engagement surface to the article. The clamping force applied by the pawl to the article is increased when an attempt is made to defeat the security tag, as shown by step 1212. Additionally in step 1214, an alarm is issued by the security tag when such an attempt is made to defeat the security tag. For example, in some scenarios, the pawl is further rotated towards the article when an attempt is made to defeat the security tag such that two conductors come in contact with each other thereby closing an alarming circuit (e.g., circuit 804 of FIG. 8) of the security tag. Issuance of the alarm can subsequently be ceased in step 1216. Thereafter in step 1218, the clamping force applied to the article by the security tag is removed using a magnetic field. In a next step 1220, the method 1200 ends or other processing is performed.

All of the apparatus, methods, and algorithms disclosed and claimed herein can be made and executed without undue experimentation in light of the present disclosure. While the invention has been described in terms of preferred embodiments, it will be apparent to those having ordinary skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those having ordinary skill in the art are deemed to be within the spirit, scope and concept of the invention as defined.

The features and functions disclosed above, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

I claim:

1. A method for operating a security tag of an Electronic Article Surveillance ("EAS") system, comprising:

sliding a sidewall of an article into a clip structure of the security tag;

rotating at least one pawl of the security tag so that the pawl is transitioned from a retracted position in which an engagement surface of the pawl is disposed within a housing of the security tag to an engaged position in which the engagement surface of the pawl extends out and away from the housing of the security tag; and applying a clamping force by the pawl to the article whereby the article is clamped between the engagement surface of the pawl and a vertical elongate member of the clip structure.

2. The method according to claim 1, further comprising increasing the clamping force applied by the pawl to the article when an attempt is made to defeat the security tag.

3. The method according to claim 2, further comprising issuing an alarm by the security tag when said attempt is made to defeat the security tag.

4. The method according to claim 3, wherein the pawl is further rotated towards the article when said attempt is made to defeat the security tag such that two conductors come in contact with each other thereby closing an alarming circuit of the security tag.

5. The method according to claim 1, further comprising applying a frictional force by the engagement surface to the article.

6. The method according to claim 1, further comprising removing the clamping force applied to the article using a magnetic field.

7. The method according to claim 1, further comprising moving a spring loaded actuator in a first direction so as to cause rotation of the pawl about a pivot in a first radial direction whereby the pawl is transitioned from the retracted position to the engaged position.

8. The method according to claim 7, further comprising moving the spring loaded actuator in a second opposed direction so as to cause rotation of the pawl about the pivot in a second radial direction whereby the pawl is transitioned from the engaged position to the retracted position.

9. The method according to claim 1, further comprising detecting when the article to which the security tag is affixed enters a surveillance zone of the EAS system.

10. A security tag for use in an Electronic Article Surveillance ("EAS") system, comprising:

a housing;

a clip coupled to said housing for slidingly receiving a sidewall of an article; and at least one pawl rotatable from a retracted position in which an engagement surface of the pawl is disposed within the housing of the security tag to an engaged position in which the engagement surface of the pawl extends out and away from the housing of the security tag;

wherein a clamping force is applied by the pawl to a sidewall of an article that has been received by the clip when the pawl is in the engaged position.

11. The security tag according to claim 10, wherein the clamping force applied by the pawl to the article is increased when an attempt is made to defeat the security tag.

12. The security tag according to claim 11, wherein an alarm is issued by the security tag when said attempt is made to defeat the security tag.

13. The security tag according to claim 12, wherein the pawl is further rotated towards the article when said attempt is made to defeat the security tag such that a first conductor is deflected to contact a second conductor thereby closing an alarming circuit of the security tag.

14. The security tag according to claim 13, wherein both conductors are disposed on a stationary component of the security tag.

15. The security tag according to claim 10, wherein the engagement surface has a material disposed thereon suitable to apply a frictional force to the article simultaneously with the clamping force.

16. The security tag according to claim 10, wherein the clamping force applied to the article is removed using a magnetic field.

17. The security tag according to claim 10, further comprising a torsion spring coupled to said pawl for facilitating the transition of the pawl from the retracted position to the engaged position.

18. The security tag according to claim 10, further comprising a spring loaded actuator movable so as to facilitate a retention of the pawl in the retracted position when the security tag is not in use and facilitate the transition of the pawl to the engaged position when protective use of the security tag is desired.

19. The security tag according to claim 18, further comprising a spring loaded plunger movable so to engage the spring loaded actuator when the security tag is in use, whereby the pawl is maintained in the engaged position.

20. The security tag according to claim 10, further comprising an EAS label disposed in the housing such that a detection can be made when the article to which the security tag is affixed enters a surveillance zone of the EAS system.

* * * * *